US005368278A

United States Patent [19]

Kurmis

[11] Patent Number: 5,368,278

[45] Date of Patent: Nov. 29, 1994

[54] APPLIANCE AND PROCESS FOR TYING AN ARTICLE, ESPECIALLY A CABLE HARNESS

[75] Inventor: Viktor Kurmis, Pinneberg, Germany

[73] Assignee: Paul Hellermann GmbH, Pinneberg, Germany

[21] Appl. No.: 214,028

[22] Filed: Mar. 15, 1994

Related U.S. Application Data

[63] Continuation of Ser. No. 978,160, Nov. 17, 1992, abandoned, which is a continuation of Ser. No. 613,246, Nov. 14, 1990, abandoned.

[30] Foreign Application Priority Data

Nov. 15, 1989 [DE] Germany ..... 8913515[U]

[51] Int. Cl.[5] ..... B21F 9/02

[52] U.S. Cl. ..... 254/216; 100/32; 140/93.2; 24/16 PB

[58] Field of Search ..... 254/215, 216, 217; 140/93.2, 123.5; 24/16 PB, 68 D; 100/30, 32, 33 PB; 226/177, 176

[56] References Cited

U.S. PATENT DOCUMENTS

| | | | |
|---|---|---|---|
| 670,928 | 4/1901 | Davison | 254/216 |
| 3,088,642 | 5/1963 | Kingsley | 226/43 |
| 3,118,473 | 1/1964 | Bell | 140/93 |
| 3,172,991 | 3/1965 | Arnoldy | 219/130 |
| 3,265,355 | 8/1966 | Martin et al. | 254/51 |
| 3,309,061 | 3/1967 | Plattner | 254/51 |
| 3,545,723 | 12/1970 | Raley | 254/79 |
| 3,556,910 | 1/1971 | Derenthal | 156/523 |
| 3,612,480 | 10/1971 | Guy | 254/51 |
| 3,657,940 | 4/1972 | Wagner | 74/397 |
| 4,015,643 | 4/1977 | Cheung | 254/51 |
| 4,160,510 | 7/1979 | Wardell, Jr. | 100/30 |
| 4,245,678 | 1/1981 | Sansum | 100/30 |
| 4,610,067 | 9/1986 | Hara | 140/93.2 |
| 4,640,320 | 2/1987 | Avison et al. | 140/93.2 |
| 5,042,535 | 8/1991 | Schlottke | 140/16 PB |

FOREIGN PATENT DOCUMENTS

| | | | |
|---|---|---|---|
| 822977 | 9/1969 | Canada | 140/93.2 |
| 0264142A2 | 9/1984 | European Pat. Off. . | |
| 0264142 | 4/1988 | European Pat. Off. . | |

*Primary Examiner*—Katherine Matecki
*Attorney, Agent, or Firm*—Chilton, Alix & Van Kirk

[57] ABSTRACT

An appliance for clamping a strap round an article has a tensioning member, it being necessary for the tension which is to be transmitted to the strap by the tensioning member to be limited to a predetermined value. This is achieved by the fact that the tensioning member (4) is designed to slip past on the strap (2,6) to be tensioned when the predetermined strap tension is reached. The tensioning member can be provided with projections penetrating into the strap surface, which projections are designed so as to remove chips or displace material during the slipping past. Advantageously the tensioning member comprises a tensioning roller.

8 Claims, 1 Drawing Sheet

APPLIANCE AND PROCESS FOR TYING AN ARTICLE, ESPECIALLY A CABLE HARNESS

This is a continuation of copending application(s) Ser. No. 07/978,160 filed on Nov. 17, 1992, abandoned, which is a continuation of Ser. No. 07/613,246, filed on Nov. 14, 1990, abandoned.

BACKGROUND AND SUMMARY OF THE INVENTION

In appliances for tying cable harnesses or other articles by means of a flexible strap which is to be secured in the tensioned tying position by means of a closing device, the limitation of the strap tension to a predetermined value is an important factor, since the article to be tied or the strap itself could be damaged as a result of too high a strap tension. The state of the art uses different forms of so-called load balances for this purpose. Thus, a coupling is inserted into the force transmission path, which transmits the tensioning force via an inclined plane and is then released when the force component acting transversely relative to the normal force transmission path as a result of the inclined plane exceeds a specific force threshold determined by an adjustable spring force. The way in which this principle is put into practice can differ greatly (German Offenlegungsschrift 2,510,575, G.B. preliminary publication 83 25128, WO 82/02867, German Offenlegungsschrift 1,907,306), but at all events involves a very high outlay. However, it has hitherto been considered essential, because the limiting tension must still be adjustable reliably even after many work cycles.

The object on which the invention is based is to put this into effect at a lower outlay.

In the solution according to the invention, the tensioning member acting on the strap is designed to slip past on the strap to be tensioned, when a predetermined strap tension is reached.

This solution is surprising in as much as it amounts to forming a slip coupling between the tensioning member and the strap to be tensioned, but slip couplings are known not, as a rule, to allow an exact and always constant setting of the slip-force limit when there is a large number of work cycles and the constructional size of the coupling has to be kept small in relation to the force to be transmitted. This is because, with slip couplings, it is necessary to allow for wear which so changes the interacting coupling surfaces that there is no permanent guarantee of a calculable functioning.

Furthermore, from a tribological point of view strict requirements are demanded of the properties of the materials forming the slip coupling. However, those materials, of which elastic straps for tying cable harnesses typically consist, are far from meeting such requirements demanded of the material properties, since they are chosen for completely different reasons. It is all the more surprising that the known disadvantages of slip couplings do not arise where the invention is concerned. There are two reasons for this. On the one hand, for each work cycle the coupling is provided with a new friction partner which is in the form of a new strap and the properties of which have not yet changed as a result of preceding work cycles. On the other hand, it is true that an essential wear-related change occurs during the slipping of the coupling past the friction partner foraged by the strap, because the friction partners of the coupling are now pressed together only with a reduced force as a result of the wear. However, this does not have a negative effect because it can easily be ensured that the closing device for the strap is closed immediately as soon as the predetermined strap tension is reached. This is guaranteed at once when a strap with a self-locking closing device (EP-A-35,367, FIG. 2) is used, that is to say one in which the closing position of the strap is determined by the maximum strap tension reached during the tensioning operation, whilst a subsequent reduction of this tension remains without any influence. It is advantageous, furthermore, if the invention makes use of straps made of plastic or at least of a material which is soft in comparison with the material of the other coupling part and which does not impart any appreciable wear to this other part of the coupling.

The tensioning member is appropriately formed by the tensioning roller. The limiting tension at which the tensioning member slips past is determined by the adjustability of the distance between the tensioning member and an abutment supporting the strap on the side facing away from the tensioning member. However, there will also be the possibility, instead, of making the force with which the strap is pressed against the tensioning member by the abutment adjustable. The abutment is appropriately a roller, especially when the tensioning member too is a roller.

Although the surface of the tensioning member can be made smooth, the frictional force acting between this surface and that of the strap being determined by the pressing force, nevertheless, since the random surface state of the strap can lead to differing results, the tensioning member is preferably designed with projections penetrating into the strap surface. When the tensioning member slips past relative to the strap, these projections bring about a deformation of the strap material which can be of a varying kind, depending on the type of projections. If the projections are sharp, a scraping or even chip-removing deformation of the strap can occur. This solution is generally preferred, because the most easily reproducible results are thereby obtained, as long as the strap material remains the same. It is also possible, however, to make the projections obtuse, in which case the plastic displacement of material (in addition to any material abrasion) can be decisive.

Since many plastic straps which can be used for the purposes according to the invention, are toothed on one side, at first sight it seems obvious to cause the tensioning member to act on the toothed side of the strap, in order to utilize for the tensioning operation the positive engagement possible as a result of the toothing. This will, indeed, be possible within the scope of the invention. But, as a rule, the action of the tensioning member on a non-toothed surface of the strap is more advantageous, because it has been shown that more easily reproducible results can then be obtained.

BRIEF DESCRIPTION OF THE DRAWINGS

The invention is explained in more detail below by reference to the drawing which illustrates a diagrammatic representation of an advantageous exemplary embodiment. In it, FIG. 1 schematically shows the part representation of a tool with a cable strap to be tensioned, FIG. 2 schematically shows a tensioning roller in engagement with a cable strap to be tensioned, without any relative movement of these two parts in relation to one another.

DETAILED DESCRIPTION OF THE PREFERRED EMBODIMENT

Figure 1:
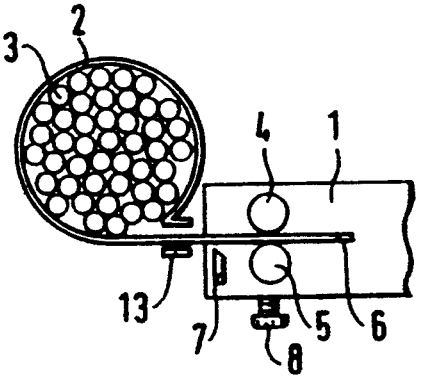

FIG. 1 shows a tool 1 for clamping a cable strap 2 round a cable harness 3. For this purpose, the tool has a tensioning roller 4 equipped with a drive (not shown) and a counterroller 5, between which the end 6 of the cable strap 2 to be tensioned is guided. Furthermore, the tool possesses a blade 7, by means of which the projecting strap end 6 subjected to the action of the tensioning roller 4 is cut off after the clamping. Of course, the tool 1 can assume a form substantially different from that shown in FIG. 1. In particular, it can be a so-called automatic tool which has guides engaging round the cable harness 3 for an automatic looping of the strap 2 round the cable harness.

The strap 2 is preferably a plastic strap, for example made of polyamide, the thickness of which is typically between 1 and 2 mm. To make it possible to adapt the distance or the pressing force between the tensioning roller 4 and the counterroller 5 to the particular strap thickness used and to adjust the strap tension, a setscrew 8 or the like is provided.

Figure 2:
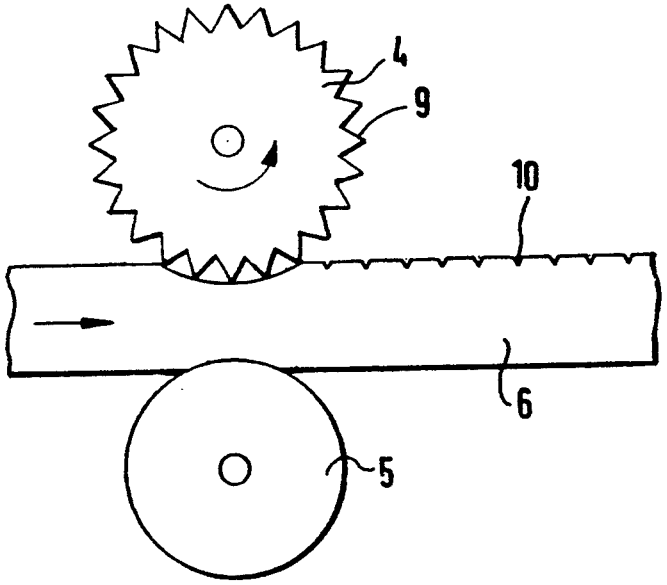
Figure 3:
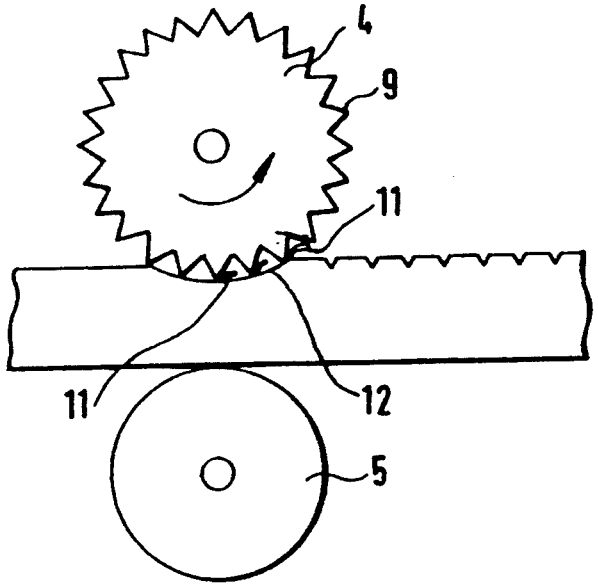
FIG. 3 shows a schematic representation, corresponding to that of FIG. 2, during the slipping past of the tensioning roller.

As shown in FIGS. 2 and 3, the tensioning roller 4 and counterroller 5 are spaced apart by distance which is less than the thickness of the strap which is to be positioned therebetween. The tensioning roller 4 is equipped on the circumference with axis-parallel rib-like projections or teeth 9, of which the radial height above the remaining roller circumference is substantially smaller than the thickness of the strap portion 6 interacting with the tensioning roller 4. On the other hand, it is so great that the projections 9 cannot slide over the surface of the strap, but penetrate into the strap surface, thereby causing a preferably plastic deformation of the latter, the depth of penetration being determined by the setting of the distance or pressing force between the rollers 4 and 5. The tracks 10 remaining on the strap do not impair its strength, because they are located in the strap portion 6 to be cut off.

The drive of the tensioning roller 4 in the direction of the arrow causes the strap to be moved in the tensioning direction. At the same time, its tension increases up to a limit at which the strength of the strap material affected by the engagement of the projections 9 can no longer withstand the force exerted on it by the projections 9. In this state shown in FIG. 3, the strap 6 is stationary in relation to the tensioning roller 4 rotating further, the projections 9 of the tensioning roller correspondingly deforming the surface of the strap. If they are made relatively sharp, as shown, this milling of the strap, i.e. the paring of chips 11 and to the formation of a recess 12 in the strap surface. Since the strap thickness effective between the tensioning roller 4 and the counterroller 5 is consequently reduced, the transmittable strap tension is also reduced. This does not matter, however, because the strap fastening in the head 13 of the strap 2 will be closed by then, for example by the use of a self-locking fastening.

It can be seen that the cross-sectional surface of the strap material loaded by the projections 9 and therefore the force transmittable to the strap 6 by the projections depend on the depth of engagement of the projections, and that the depth of engagement therefore also makes it possible to adjust the strap tension at which the tensioning operation is terminated as a result of the slipping of the tensioning roller 4 past the strap portion 6. The arrangement is extremely simple and effective and allows a considerable reduction of the outlay in comparison with conventional strap-tension limiters. The appliance is also not subject to wear, because the tensioning roller 4 can easily be produced from a material which is so hard in comparison with the strap material that it is exposed to virtually no wear at all.

I claim:

1. An apparatus for tying an article with a flexible plastic strap having a predetermined strength and a predetermined untensioned thickness, the apparatus comprising:

a tensioning member for tensioning the strap to a predetermined tension, the tensioning member including a rotatable toothed roller, and an abutment spaced from the toothed roller of the tensioning member by a set, predetermined distance for receiving the strap therebetween, which set distance is smaller than the predetermined untensioned thickness of the strap, the abutment maintaining the set distance during passage of the strap between the toothed roller and the abutment, whereby the teeth of the roller penetrate the surface of the strap when the strap is between the abutment and rotatable toothed roller of the tensioning member, the predetermined tension of the strap being substantially equal to the resistance of the strap to a milling action by the toothed roller against the strap during rotation of the roller when the strap is maintained in a tensioned but stationary position relative to the abutment.

2. An apparatus according to claim 1, wherein the strap has a smooth surface which is engaged by the teeth of the toothed roller.

3. An apparatus according to claim 1, wherein the strap is self-locking.

4. An apparatus according to claim 1, wherein the abutment includes a roller.

5. A method for tying an article using an apparatus comprising a flexible plastic strap having a predetermined strength and a predetermined untensioned thickness, a tensioning member including a rotatable toothed roller for tensioning the strap to a predetermined tension, and an abutment spaced from the toothed roller of the tensioning member by a set, predetermined distance for receiving the strap therebetween, which set distance is smaller than the predetermined thickness of the strap, the abutment maintaining the set distance during passage of the strap between the toothed roller and abutment, whereby the teeth of the roller penetrate the surface of the strap when the strap is between the abutment and toothed roller of the tensioning member, the method comprising:

(a) selecting the flexible plastic strap, (b) placing the strap between the tensioning member and abutment in engagement with the teeth of the toothed roller, and (c) after steps (a)–(b), driving the tensioning member, wherein the strap is advanced by the tensioning member while the teeth of the toothed roller penetrate the surface of the strap, and wherein after the predetermined tension is reached, the strap remains stationary relative to the toothed roller and abutment while the toothed roller is driven and the teeth of the toothed roller mill the strap.

6. A method according to claim 5, wherein the strap has a smooth surface, and the placing step includes placing the smooth surface of the strap in engagement with the teeth of the toothed roller.

7. A method according to claim 5, further comprising the step of locking the strap with a self-locking mechanism on the strap.

8. A method according to claim 5, further comprising the step of adjustably fixing the predetermined, set distance between the abutment and toothed roller before step (b).

* * * * *